US008905138B2

(12) United States Patent
Lundstedt et al.

(10) Patent No.: US 8,905,138 B2
(45) Date of Patent: Dec. 9, 2014

(54) SYSTEM TO HEAT WATER FOR HYDRAULIC FRACTURING

(75) Inventors: Garry R. Lundstedt, Fort Collins, CO (US); Brian R. Lundstedt, Fort Collins, CO (US); Lloyd D. Leflet, Fort Collins, CO (US)

(73) Assignee: H2O Inferno, LLC, Fort Collins, CO (US)

( * ) Notice: Subject to any disclaimer, the term of this patent is extended or adjusted under 35 U.S.C. 154(b) by 310 days.

(21) Appl. No.: 13/479,022

(22) Filed: May 23, 2012

(65) Prior Publication Data

US 2013/0312972 A1 Nov. 28, 2013

(51) Int. Cl.
*E21B 43/26* (2006.01)

(52) U.S. Cl.
USPC ..... 166/308.1; 166/177.5

(58) Field of Classification Search
CPC ..... E21B 43/26; E21B 43/267
USPC ..... 166/308.1, 177.5
See application file for complete search history.

(56) References Cited

U.S. PATENT DOCUMENTS

| | | | | |
|---|---|---|---|---|
| 2,065,789 | A | 12/1936 | Bolsinger | |
| 2,122,900 | A | 7/1938 | Reif | |
| 2,395,258 | A | 2/1946 | Calvin | |
| 2,486,141 | A | 10/1949 | Follo | |
| 2,631,017 | A | 3/1953 | Clyde | |
| 3,379,250 | A | 4/1968 | Matthews et al. | |
| 3,411,571 | A | 11/1968 | Thompson | |
| 3,421,583 | A | 1/1969 | Koons | |
| 3,454,095 | A | 7/1969 | Webster et al. | |
| 3,572,437 | A | 3/1971 | Marberry et al. | |
| 3,581,822 | A | 6/1971 | Cornelius | |
| 3,816,151 | A | 6/1974 | Podlas | |
| 3,938,594 | A | 2/1976 | Rhudy | |
| 3,980,136 | A | 9/1976 | Plummer et al. | |
| 4,076,628 | A | 2/1978 | Clampitt | |
| 4,137,182 | A | 1/1979 | Golinkin | |
| 4,518,568 | A | 5/1985 | Shannon | |
| 4,773,390 | A * | 9/1988 | Watts | 126/355.1 |
| 4,791,822 | A | 12/1988 | Penny | |
| 4,807,701 | A | 2/1989 | Hall et al. | |
| 4,922,758 | A | 5/1990 | Penny | |
| 5,018,396 | A | 5/1991 | Penny | |
| 5,038,853 | A | 8/1991 | Callaway | |
| 5,183,029 | A | 2/1993 | Ranger | |
| 5,445,181 | A | 8/1995 | Kuhn et al. | |
| 5,467,799 | A | 11/1995 | Buccicone et al. | |
| 5,494,077 | A | 2/1996 | Enoki et al. | |
| 5,551,630 | A | 9/1996 | Enoki et al. | |
| 5,586,720 | A | 12/1996 | Spiegel et al. | |
| 5,979,549 | A | 11/1999 | Meeks | |
| 6,470,836 | B1 | 10/2002 | Manley et al. | |
| 8,171,993 | B2 * | 5/2012 | Hefley | 166/303 |
| 2008/0029267 | A1 | 2/2008 | Shampine | |

(Continued)

FOREIGN PATENT DOCUMENTS

| | | |
|---|---|---|
| WO | WO 2010/018356 A2 | 2/2010 |
| WO | WO 2010/018356 A3 | 2/2010 |
| WO | WO/2011/034679 | 3/2011 |

*Primary Examiner* — William P Neuder

(74) *Attorney, Agent, or Firm* — Craig R. Miles; CR Miles, P.C.

(57) ABSTRACT

Generally, a system for hydraulic fracturing of a geologic formation. Specifically, a transportable heating apparatus and method for the production of heated water for use in hydraulic fracturing of a geologic formation.

19 Claims, 4 Drawing Sheets

(56) References Cited

U.S. PATENT DOCUMENTS

| | | | | |
|---|---|---|---|---|
| 2009/0056645 | A1 | 3/2009 | Hobbs et al. | |
| 2010/0000508 | A1 | 1/2010 | Chandler | |
| 2010/0032031 | A1 | 2/2010 | Neal | |
| 2010/0294494 | A1* | 11/2010 | Hefley | 166/272.2 |
| 2012/0181033 | A1* | 7/2012 | Saini et al. | 166/308.1 |
| 2012/0255735 | A1* | 10/2012 | Hefley | 166/308.1 |
| 2013/0233547 | A1* | 9/2013 | Twardowski et al. | 166/285 |

* cited by examiner 27
28/51
31
33
52
53
29
30
FUEL PUMP REGULATOR
57
56
58
59
60
61
62
54
55
RECIRCULATING PUMP
64
50
48
46
47
63
44
45
35
49
65

SYSTEM TO HEAT WATER FOR HYDRAULIC FRACTURING

I. FIELD OF THE INVENTION

Generally, a system for hydraulic fracturing of a geologic formation. Specifically, a transportable heating apparatus and method for the production of heated water for use in hydraulic fracturing of a geologic formation.

II. BACKGROUND OF THE INVENTION

Hydrocarbons such as oil, natural gas, or the like can be obtained from a subterranean geologic formation by drilling a wellbore which penetrates the geologic formation providing a partial flowpath for the hydrocarbon to the Earth's surface. In order for the hydrocarbon to flow from the geologic formation to the wellbore there must be a sufficiently unimpeded flow path.

FIG. 1 generally illustrates a conventional hydraulic fracturing process (1). Hydraulic fracturing (also often referred to as "hydrofracking", "waterfrac", "fracking" or "fracing") can improve the productivity of a geologic formation (2) surrounding a wellbore (3) by inducing fractures or extending existing fractures through which geologic formation fluids (4) such as hydrocarbon fluids, oil, gas, or the like, can flow toward the wellbore (3). Typically, hydraulic fracturing is accomplished by injecting a hydraulic fracturing fluid (5) through the wellbore (3) into the subterranean geologic formation (2) from one or more hydraulic fracturing pumps (6) at a flow rate that exceeds the filtration rate into the geologic formation (2) thereby increasing hydraulic pressure at the face of the geologic formation. When the hydraulic pressure increases sufficiently the rock or strata of the geologic formation (2) can fracture or crack. The induced cracks and fractures may then make the geologic formation (2) more porous releasing geologic formation fluids (4) such as oil, gas, or the like, that would be otherwise remain trapped in the geologic formation (2).

Generally, conventional hydraulic fracturing processes (1) include a hydration unit (9) to admix an amount of water (7) obtained from a water source (8) with one or more hydratable materials (10) including for example: a guar such as phytogeneous polysaccharide, guar derivatives such as hydroxypropyl guar, carboxymethylhydroxypropyl guar, or the like. Other polymers can also be used to increase the viscosity of the hydraulic fracturing fluid (5). Cross-linking agents can also be used to generate larger molecular structures which can further increase viscosity of the hydraulic fracturing fluid (5). Common crosslinking agents for guar include for example: boron, titanium, zirconium, and aluminum.

Proppants (11) can be further admixed into the hydraulic fracturing fluid (5) by use of a blender (12) and injected into the wellbore (3) as part of the conventional hydraulic fracturing process (1). The proppant (11) can form a porous bed, permeable by geologic formation fluids (4), such as oil or gas, that resists fracture closure and maintains separation of fracture faces after hydraulic fracturing of the geologic formation (2). Common proppants (11) include, but are not limited to, quartz sands; aluminosilicate ceramic, sintered bauxite, and silicate ceramic beads; various materials coated with various organic resins; walnut shells, glass beads, and organic composites.

Typcially, conventional hydraulic fracturing processes (1) heat the amount of water (7) from ambient temperature to at least 40 degrees Fahrenheit ("° F.") in the preparation of hydraulic fracturing fluids (5) within a closed system heater (13) in which the amount of water (7) is periodically contained, such as a boiler, or flowed within, such as pipes. Because conventional systems utilize a closed system heating unit (13), the amount of water (7) can be superheated (to about 240° F.) and then mixed with an amount of water (7) at ambient temperature by use of a mixing unit (14) including at least one mixing pump (15) and a mixing valve (16). The amount of water (7) delivered from the closed system heater (13) can then be stored in one or more storage tanks (17). The term "ambient temperature" as used in this description means the temperature of the amount of water (20) received by the heating apparatus (21).

Even though a wide variety of conventional hydraulic fracturing processes (1) exist, there remain longstanding unresolved limitations common to their use. First, the efficiency of conventional closed system heater units (13) can be about 60%. For example, for each 35,000,000 British Thermal Units ("BTU") only about 21,000,000 BTU contribute to thermal gain increasing the temperature of the amount of water (7). The remaining 14,000,000 BTU are lost to the surrounding environment.

Second, a single conventional heater unit (13) cannot generate an amount of water (7) at flow rates or temperatures for delivery directly to the one or more fracturing pumps (6) for hydraulic fracturing of a geologic formation (2) surrounding a wellbore (3). Conventional heater units (13) which include a boiler periodically retain, heat and discharge an amount of water (7), a heated flow of water for injection into a wellbore (3) for hydraulic fracturing can only be continuous from a boiler type of conventional heater unit (13) when an amount of water (7) is being heated in one or more heater units (13) and an amount of water (7) is being discharged from another one or more heater units (13). Alternately, in conventional heater units (13) in which an amount of water (7) flows through a plurality of heated conduits, the amount of water (7) can have a relatively low flow rate (typically less than 400 gallons per minute). As a result, the conventional wisdom is to use one or combination of remedies: use additional conventional heater units (13), use one or more storage tanks (17) in which an amount of water (7) previously heated can be stored, or use an amount of water (7) superheated in a conventional heater unit (13) mixed with an amount of water (7) at ambient temperature. All of these remedies necessitate additional equipment and persons to operate the additional equipment at substantial cost.

The instant invention provides an inventive geologic formation hydraulic fracturing system substantially different from conventional hydraulic fracturing procedures to address the above described disadvantages.

III. SUMMARY OF THE INVENTION

A broad object of the invention can be to provide a geologic formation hydraulic fracturing system in which each heating apparatus is capable of heating an amount of water at ambient temperature to a sufficient temperature at a sufficient flow rate which can be delivered directly to high pressure pumps for high pressure injection into a wellbore for hydraulic fracturing of a geologic formation. As to particular embodiments, each heating apparatus heats an amount of water from ambient temperature to at least 40 degrees Fahrenheit at a flow rate of between about 400 gallons per minute and about 2,100 gallons per minute for direct high pressure injection into a wellbore for hydraulic fracturing of a geologic formation. As to other particular embodiments, each heating apparatus heats an amount of water at a continuous flow rate of between 350 gallons per minute and about 700 gallons per minute from an ambient temperature of between about 32 degrees Fahrenheit to 110 degrees Fahrenheit by at least 40 degrees Fahrenheit (about 22 degrees Celsius) which can be delivered directly to high pressure pumps for high pressure injection into a wellbore for hydraulic fracturing of a geologic formation. Embodiments of the geologic formation hydraulic fracturing system can provide a heating apparatus in the form of a stationary or transportable heating apparatus. Each of the embodiments of the geologic formation hydraulic fracturing system can operate to provide sufficient amounts of heated water for hydraulic fracturing of a geologic formation without use of one or more of: additional heater units, a mixer unit in which an amount of water at ambient temperature mixes with an amount of heated or superheated water, or storage tanks for storage of heated water.

Another broad object of the invention can be to provide a method of hydraulic fracturing of a geologic formation which includes flowing an amount of water from a water source to one heating apparatus (whether stationary or transportable) at an ambient temperature of between about 32 degrees Fahrenheit (about 0 degrees Celsius) and about 110 degrees Fahrenheit (about 43 degrees Celsius), continuously flowing the amount of water through the heating apparatus at a flow rate of between about 500 gallons per minute and about 2100 gallons per minute, heating the amount of water solely with one heating apparatus from the ambient temperature to a temperature of between about 40 degrees Fahrenheit (about 4 degrees Celsius) and about 150 degrees Fahrenheit (about 66 degrees Celsius), delivering the amount of water from the heating apparatus to one or more fracturing pumps, and injecting the amount of water into a wellbore at sufficient pressure for fracturing of said geologic formation. The method of hydraulic fracturing of a geologic formation can operate without one or more of the following steps: using additional heater units, mixing an amount of water at ambient temperature with an amount of heated or superheated water, or storing heated water in storage tanks.

Naturally, further objects of the invention are disclosed throughout other areas of the specification, drawings, photographs, and claims.

IV. BRIEF DESCRIPTION OF THE DRAWINGS

V. DETAILED DESCRIPTION OF THE INVENTION

Figure 2:
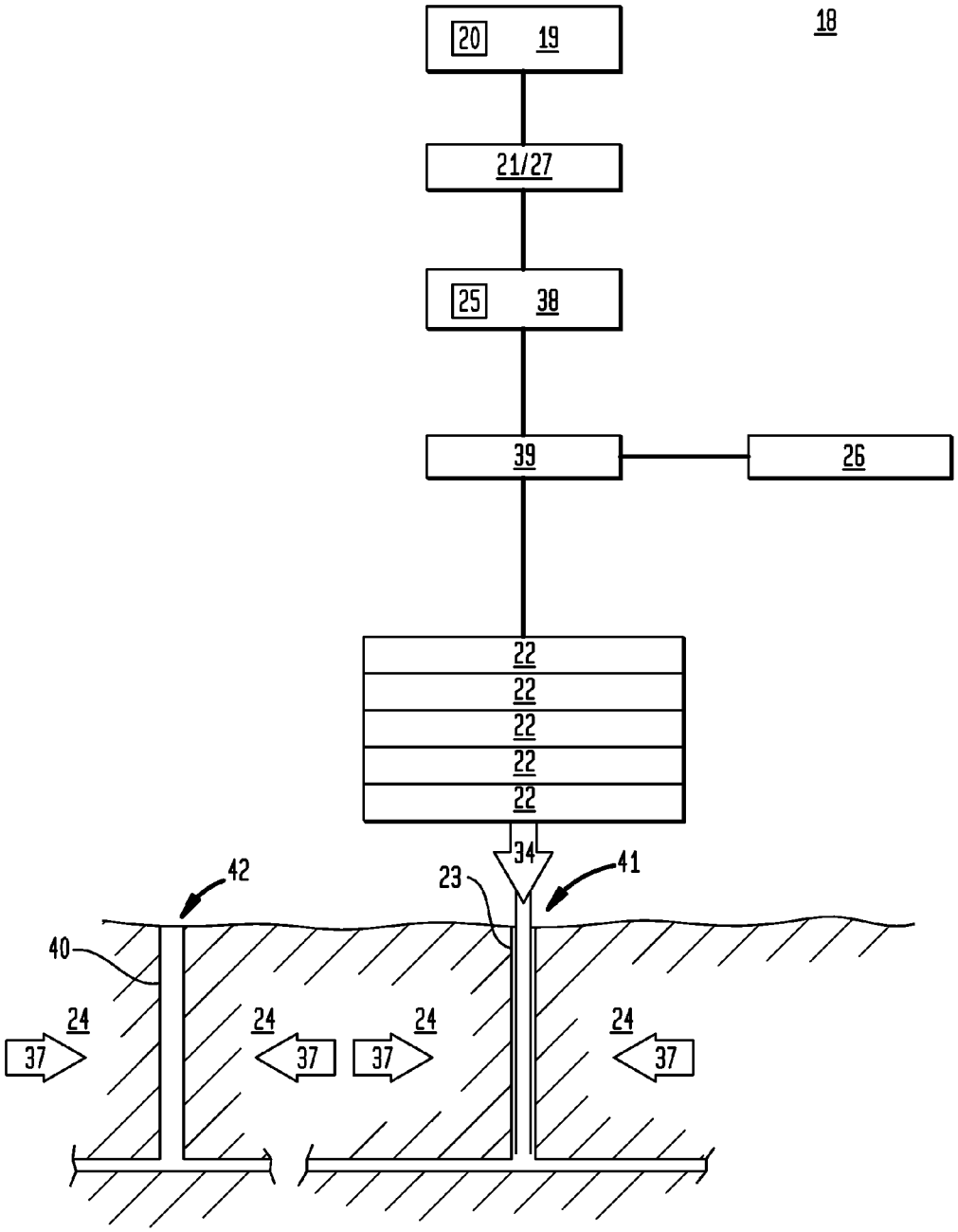
FIG. 2 is a schematic diagram of an embodiment of the inventive system for hydraulic fracturing of a geologic formation.

Now referring to primarily to FIG. 2, which shows an exemplary embodiment of the inventive geologic formation hydraulic fracturing system (18) (also referred to as the "system (18)"). Embodiments of the inventive geologic formation hydraulic fracturing system (18) include a water source (19) which supplies an amount of water (20) at ambient temperature to a heating apparatus (21) which heats the amount of water (20) to a temperature suitable for delivery to one or more fracturing pumps (22) which inject the amount of water (20) into a wellbore (23) under sufficient pressure to hydraulically fracture the associated geologic formation (24).

The water source (19) can be of any configuration containing an amount of water (20) sufficient to deliver a flow rate of between about 10 barrels (420 gallons) per minute and about 50 barrels (2100 gallons) per minute to a heating apparatus (21) for each heater apparatus (21). Examples of the total amount of water (20) used in hydraulic fracturing of the geologic formation (24) associated with a wellbore (23) is about 30,000 barrels (1,260,000 gallons) to about 350,000 barrels (14,700,000 gallons) although a greater or lesser total amount of water (20) can be used depending on the particular configuration of the wellbore (23), the temperature of the amount of water (20), the type and amount of hydratable materials (25) combined with the amount of water (20) and the type and amount of proppants (26) combined with the amount of water (20). Typically, the water source (19) comprises a lake, a reservoir, a pond, tank, pipeline, or the like, from which the amount of water (20) can be delivered at an ambient temperature of between about 32 degrees Fahrenheit ("° F.") (about 0 degrees Celsius ("° C.") just above freezing) to about 110° F. (about 43 degrees Celsius).

Figure 3:
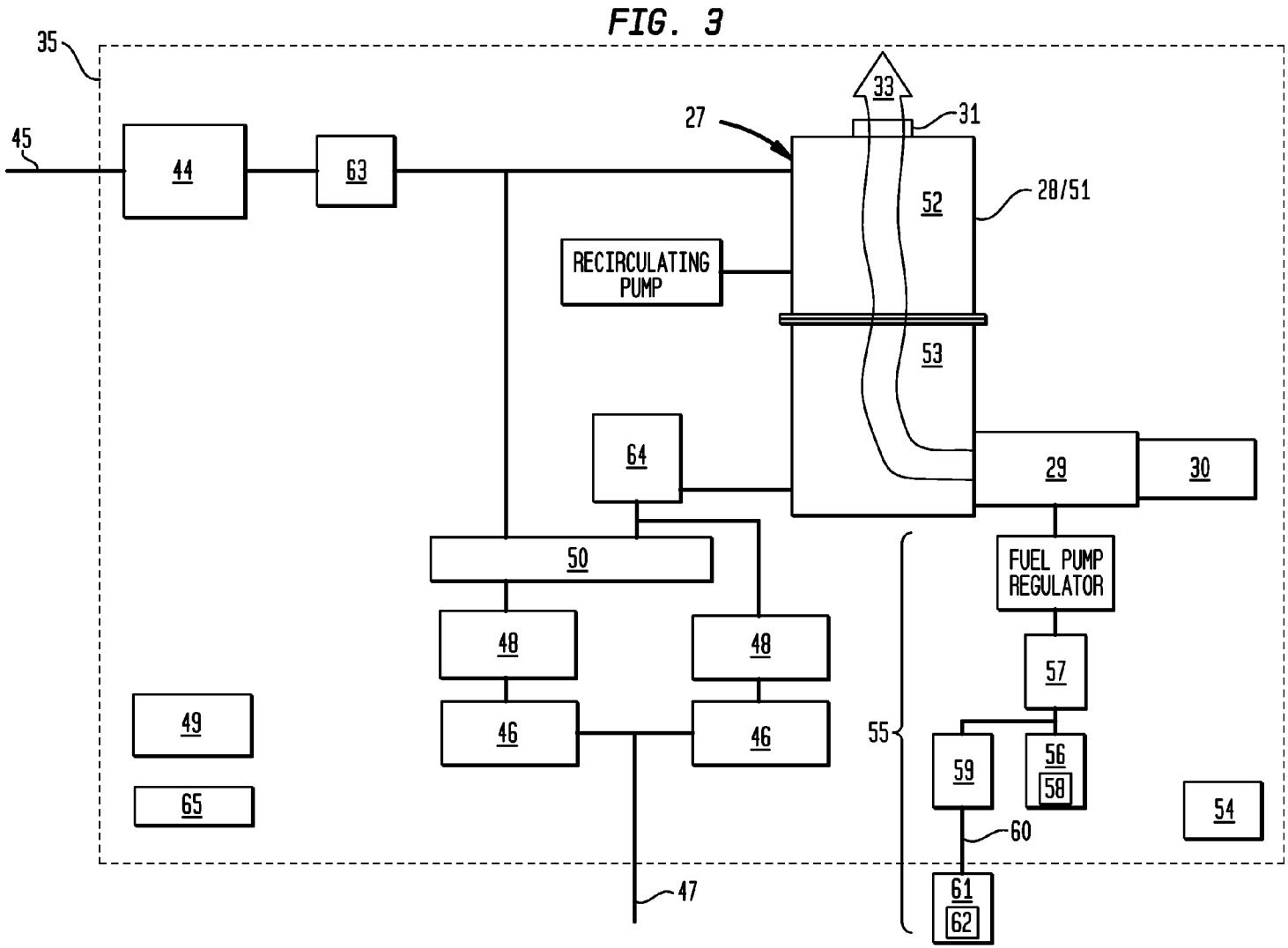
FIG. 3 is a schematic diagram of an embodiment of a transportable heater apparatus.

Now referring primarily to FIGS. 2 and 3, the heating apparatus (21) utilized in embodiments of the inventive geologic formation hydraulic fracturing system (18) can be configured to include a direct contact heater (27) through which the amount of water (20) flows at a rate of between about 10 barrels (420 gallons) per minute and about 50 barrels (2100 gallons) per minute. The amount of water (20) can be heated flowing through the heating apparatus (21) from ambient temperature to a temperature suitable for hydraulic fracturing of a geologic formation (24) associated with one or more wellbores (23). One example of a direct contact heater (27) suitable for use in embodiments of the invention is described in U.S. Pat. No. 4,773,390, hereby incorporated by reference herein. However, embodiments of the inventive system (18) can utilize other types and kinds of direct contact heaters which allow an amount of water (20) to be heated at flow rates of about 10 barrels (420 gallons) per minute and about 50 barrels (2100 gallons) per minute from ambient temperature to a temperature of at least about 40° F. (about 4° C.) without superheating the water, blending heated or superheated water with ambient temperature water.

Now referring primarily to FIG. 3, generally, a direct contact heater (27) includes a water tower (28), a combustion chamber (29) coupled to the water tower (28), and an air flow generator (30) which flows air through the water tower (28) to an exhaust vent (31). For the purpose of delivering an amount of water (24) at a sufficient flow rate and temperature to a wellbore (23) for the hydraulic fracture of the associated geologic formation (24), the amount of water (24) can be delivered to the top of the water tower (28) at a rate of between about 10 barrels (420 gallons) per minute and about 50 barrels (2100 gallons) per minute. Concurrently, an amount of fuel (32) can be combusted in the combustion chamber (29). The heated gases (33) produced by the combustion of the amount of fuel (32) flow upwardly within the water tower (28) and ultimately out a flue vent (34). As the heated gases (33) flow upwardly within the water tower (28), the amount of water (20) can be dispersed inside of the water tower (28) falling toward the bottom of the water tower (28). As the amount of water (20) passes downwardly in the water tower (28) heat can be absorbed from the heated gases (33) passing upwardly in the water tower (28). The heated amount of water (20) can flow from the bottom of the water tower (28) to the one or more fracturing pumps (22) which sufficiently pressurize the amount of water (20) for injection into one or more wellbores (23) for the hydraulic fracturing of the associated geologic formation (24).

The heating apparatus (21) utilized in embodiments of the inventive geologic formation hydraulic fracturing system (18) which continuously heats the amount of water (20) from ambient temperature to a temperature and flow rate which can be used directly in hydraulic fracturing without the use of storage tanks, water mixing valves, and other components used in the conventional hydraulic fracturing process (1), as further described below, allows for a substantial redesign of the conventional hydraulic fracturing process (1) to the inventive hydraulic fracturing system (18) which confers many advantages over the conventional process (1).

Figure 4:
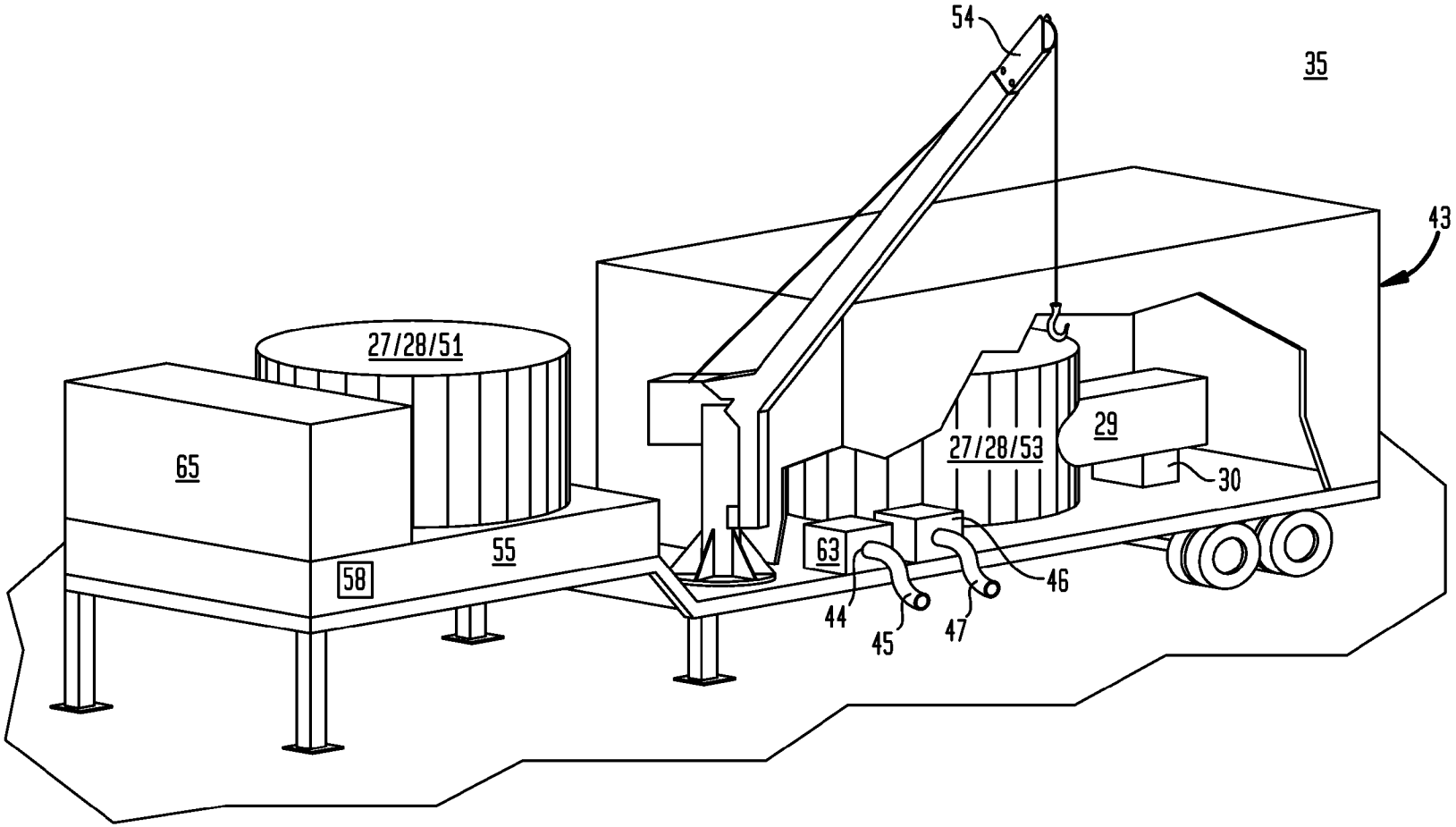
FIG. 4 is a perspective drawing of the embodiment of the transportable heater apparatus schematically diagramed in FIG. 3.

First, the efficiency of the heating apparatus (whether a stationary heating apparatus (21) as shown in the example of FIG. 2 or a transportable heating apparatus (35) as shown in the example of FIGS. 3 and 4) used in embodiments of the inventive system (18), such as a direct contact heater (27), can be substantially greater than conventional heater units (13). A direct contact heater (27), as above described, utilized with particular embodiments of the system (18) can be 99 percent ("%") efficient as compared to conventional heater units (13) used to heat water for conventional hydraulic fracturing processes (1) which are typically about 60% efficient. For example, for each 35,000,000 British Thermal Units ("BTU") utilized, the heating apparatus utilized with embodiments of the system (18) can achieve a thermal gain in an amount of water (27) of about 34,650,000 BTU while the conventional heater unit (13) used in a conventional hydraulic fracturing process (1) achieves a thermal gain in an amount of water (7) of about 21,000,000 BTU, plus substantial thermal losses while being mixed with ambient temperature water or while being held in storage tanks (17).

Second, heating apparatus (21) (whether or not direct contact or whether stationary or transportable) utilized with embodiments of the system (18) can continuously heat an amount of water (20) flowing at a rate of between about 10 barrels (420 gallons) per minute and about 50 barrels (2100 gallons) per minute from ambient temperature to a temperature suitable for hydraulic fracturing of a geologic formation (24) (typically greater than 40° F.) without the use of conventional mixing units (14) which combine an amount of water (7) at ambient temperature with an amount of water (7) heated or superheated water to produce an amount of water at a temperature suitable for hydraulic fracturing of a geologic formation (4), for example, as described in WO 2011/034679.

Third, the heating apparatus (21) utilized with embodiments of the system (18) can heat an amount of water (20) having a flow rate which is substantially higher than a conventional heater unit (13). Typically, a conventional heater unit (13) used to heat an amount of water (7) for hydraulic fracturing of a geologic formation (2) has a maximum flow rate of about 8 barrels per minute (about 336 gallons per minute). In order to achieve a greater maximum flow rate two or more conventional heating units (13) are fluidly coupled and the flows of heated water are combined. The heating apparatus (21) utilized with embodiments of the inventive system (18) operate to continuously heat an amount of water (20) having a flow rate directly useful in hydraulic fracturing of a geologic formation (24) of between about 10 barrels per minute (500 gallons per minute) and about 50 barrels per minute (2100 gallons per minute). This flow rate is substantially greater than the flow rate achievable by conventional heater units (13) utilized in conventional hydraulic fracturing processes (1) and in part allows for the configuration of the inventive system (18) which avoids the use of or operates without a second heater unit (13), mixing units (16), or storage tanks (17).

Fourth, because particular types of conventional heater units (13) typically periodically retain and heat an amount of water (7), a heated flow of water for injection into a wellbore (3) for hydraulic fracturing can only be continuous when there is plurality of conventional heater units (13) such that an amount of water (7) can be heated in one or more boilers while being delivered from one or more additional boilers or unless the amount of water (7) heated water by conventional heater units (13) is stored in one or more storage tanks (17). By comparison, the amount of water (7) heated by the heating apparatus (21) of the inventive system (18) can be continuously heated at a flow rate and to a temperature which can delivered to high pressure pumps (22) for injection into a wellbore (23) for hydraulic fracturing of the associated geologic formation (24) which avoids the use of, or substantially reduces the number of heating units (13) and storage tanks (17).

Fifth, the increase in temperature in an amount of water (20) achievable by the heating apparatus (21) utilized in embodiments of the inventive system (18) is substantially greater than achievable by conventional heater units (13). The heating apparatus (21) utilized in embodiments of the invention can achieve an increase in temperature in an amount of water (20) of about 40 barrels (680 gallons) at an ambient temperature of about 32° F. (about 0° C.) of between about 40° F. and 100° F. (also referred as the "degrees of rise") over a period of about one minute. By comparison, a conventional heating unit (13) can only achieve an increase in temperature of an amount of water (7) of about 40 barrels (680 gallons) at an ambient temperature of about 32° F. (about 0° C.) of about 25° F. over a period of about one minute and then only if a lesser amount of water (7) is superheated and mixed with an amount of water (7) at ambient temperature to make up the 40 barrels. When scaled up, a single heating apparatus (21) used in the inventive system (18) without the use of mixing units (16) or storage tanks (17) can heat an amount of water (20) of 25,000 barrels to 40° F. of rise in 10 hours. By comparison, the conventional heater unit (13) using a mixing unit (16) in a conventional hydraulic fracturing processes (1) requires 16.6 hours to heat 25,000 barrels to 40° F. of rise.

Again referring primarily to FIG. 2, embodiments of the inventive geologic formation hydraulic fracturing system (18) can further include one or more fracturing pumps (22) fluidly coupled between the heating apparatus (21) and the wellbore (23). The one or more fracturing pumps (36) receives an amount of water (20) from the heating apparatus (21) and injects the amount of water (20) into the wellbore (23) at sufficient pressure to hydraulically fracture the geologic formation (24), or a sufficient portion of the geologic formation, surrounding the wellbore (23) to release geologic formation fluids (37) such as oil, gas, or the like or combinations thereof. A wide variety of pumps can be obtained and utilized in embodiments of the system (18) which typically operate to achieve a flow rate in the range of about 30 gallons per minute to about 100 gallons per minute at a pressure in the range of about 6,000 pounds per square inch ("psi") and about 15,000 psi. As one example, one or more high pressure triplex plunger pumps (brand name YaLong, Model No. YL600(S)) available from Nanjing Yalong Technology Company, Ltd., Jiansu, China can be used in embodiments of the geologic formation hydraulic fracturing system (18).

Again referring primarily to FIG. 2, embodiments of the inventive geologic formation hydraulic fracturing system (18) can further include a hydratable material mixer (38)

configured to combine an amount of hydratable material (25) into the amount of water (20) flowing between the heating apparatus (21) and the one or more fracturing pumps (36). The hydratable material (25) can include polymers, for example, a guar such as phytogeneous polysaccharide, guar derivatives such as hydroxypropyl guar, carboxymethylhydroxypropyl guar. Other polymers can also be used to increase the viscosity of the amount of water (20) as are well known by those of ordinary skill in the hydraulic fracturing arts. Cross-linking agents can also be used to generate larger molecular structures which can further increase viscosity of the amount. Common crosslinking agents for guar include boron, titanium, zirconium, and aluminum. One or various combinations of hydratable material (25), cross-linking agents, or the like, can be combined with the amount of water (20) flowing from the heating apparatus (21) to the one or more fracturing pumps (36) to achieve the desired viscosity. The hydratable material mixer (38) (also referred to as a "hydration unit" or "frac gel hydration unit") typically comprises a trailer, engine, hydraulic system, fracturing gel hydration tank, suction and discharge manifolds, chemical tanks, liquid additive chemical pumps, conduits, valves and controls for normal operation. Hydratable material mixers (hydration units) (38) suitable for use with embodiments of the geologic formation hydraulic fracturing system (18) can be obtained for example from Freemyer Industrial Pressure LP, 1500 North Main, Street, Suite 127, Fort Worth, Tex. 76164.

Again referring primarily to FIG. 2, embodiments of the geologic formation hydraulic fracturing system (18) can further include a proppant mixer (39) (also referred to as a "blender") configured to introduce an amount of proppant (26) into said amount of water (20) delivered to the one or more fracturing pumps (22). Common proppants (26) include but are not limited to quartz sands; aluminosilicate ceramic, sintered bauxite, and silicate ceramic beads; various materials coated with various organic resins; walnut shells, glass beads, and organic composites. The propant mixer (39) or blender generally comprises a trailer, engine, hydraulic system, hydraulically driven pumps and proppant screws, pumps, conduits, valves and controls for normal operation. Typically, the proppant mixer (39) can achieve a proppant discharge rate of about 6,000 kilograms/minute into about 10 $m^3$ per minute fluid. The truck mounted proppant mixer (39) for blending an amount of proppant (26) into the amount of water (20) or amount of water (20) mixed with an amount of hydratable material (25) as manufactured by C.A.T. GmbH, Vorruch 6, 29227 Celle, Germany provides an example of a proppant mixer (39) suitable for use with embodiments of the geologic formation hydraulic fracturing system (18).

Again referring to FIG. 2, embodiments of the geologic formation hydraulic fracturing system (18) can further include a wellbore (23) into which the one or more fracturing pumps (22) inject the amount of water (20) or the amount of water (20) into which an amount of hydratable material (25) or proppant (26), or both, have been mixed, as above described. While particular embodiments of the system (18) can include a wellbore (23) which penetrates a geologic formation (24) which can be hydraulically fractured for the production of hydrocarbon fluids (37) such as oil or gas or mixtures thereof, other embodiments of the system (18) can include a wellbore (23) which penetrates a geologic formation (24) which can be hydraulically fractured for other purposes such as injection of an amount of water to stimulate the production of hydrocarbon fluids (37) from a second wellbore (40).

Figure 1:
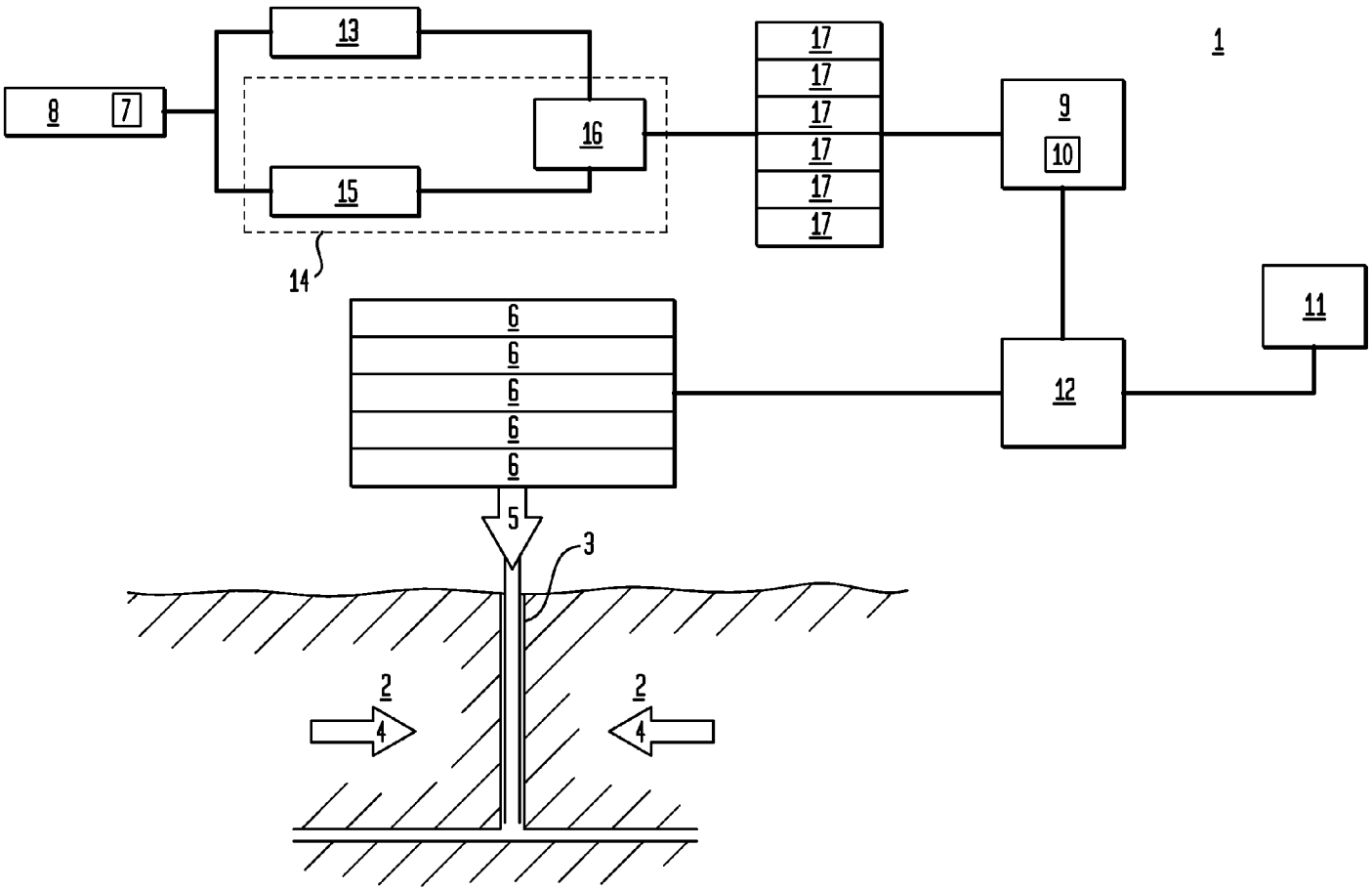
FIG. 1 (CONVENTIONAL ART)
FIG. 1 is a schematic diagram of a conventional hydraulic fracturing system.

Now referring primarily to FIGS. 3 and 4, particular embodiments of the geologic formation hydraulic fracturing system (18) can include a transportable heating apparatus (35) which can be relocated from a first wellbore location (41) to a second wellbore location (42) or relocated between or among a plurality of wellbore locations in the form of a wheeled vehicle (43) such as a truck-trailer, truck, trailer (as shown in the example of FIG. 4), or the like. While the transportable heating apparatus (35) can be used as part of various embodiments of the geologic formation hydraulic fracturing system (18) shown in FIG. 2 and as above described, the transportable heating apparatus (18) can also be used to replace or to supplement the conventional heater apparatus (13) used in conventional hydraulic fracturing processes (1), as shown in FIG. 1 and as above described.

Embodiments of the transportable heating apparatus (35) comprise a heating apparatus (21) as above described, and as to particular embodiments, a direct contact heater (27), a water inlet fitting (44) configured to connect the transportable heating apparatus (35) to a first water flowline (45) which delivers an amount of water (20) at an ambient temperature from a water source (24), and a water outlet fitting (46) configured to connect the transportable heating apparatus (35) to a second water flowline (47) which delivers the amount of water (29) from the transportable heating apparatus (35) to the one or more fracturing pumps (22) which inject the amount of water (20) into a wellbore (23) at sufficient pressure to hydraulically fracture the surrounding geologic formation (24). The transportable heating apparatus (35) can confer all the advantages of the heating apparatus (21) above described to the geologic formation hydraulic fracturing system (18) or to conventional hydraulic fracturing processes (1) modified by incorporation of the transportable heating apparatus (35).

Accordingly, embodiments of the transportable heating apparatus (35) can heat an amount of water (20) received at ambient temperature having a flow rate through the transportable heating apparatus which falls in the range of about 10 barrels per minute (about 500 gallons per minute) and about 50 barrels per minute (2100 gallons per minute). As to particular embodiments of the transportable heating apparatus (35), the flow rate of the amount of water having ambient temperature can be selected the group including or consisting of: between about 500 gallons per minute and about 700 gallons per minute, between about 600 gallons per minute and about 800 gallons per minute, between about 700 gallons per minute and about 900 gallons per minute, between about 800 gallons per minute and about 1,000 gallons per minute, between about 900 gallons per minute and about 1100 gallons per minute, between about 1,000 gallons per minute and about 1,200 gallons per minute, between about 1,100 gallons per minute and about 1,300 gallons per minute, between about 1,200 gallons per minute and about 1,400 gallons per minute, between about 1,300 gallons per minute and about 1,500 gallons per minute, between about 1,400 gallons per minute and about 1,600 gallons per minute, between about 1,500 gallons per minute and about 1,700 gallons per minute, between about 1,600 gallons per minute and about 1,800 gallons per minute, between about 1,700 gallons per minute and about 1,900 gallons per minute, between about 1,800 gallons per minute and about 2,000 gallons per minute, and between about 1,900 gallons per minute and about 2,100 gallons per minute.

The particular flow rate of the amount of water can be adjusted to heat the amount of water (20) from ambient to a temperature of at least 40 degrees Fahrenheit (about 22° Celsius) while continuously maintaining a flow rate which falls in the range of between about 500 gallons per minute and about 2,100 gallons per minute. As to other embodiments, the particular flow rate of the amount of water (20) can be adjusted to continuously maintain a flow rate of between 400 gallons per minute and 700 gallons per minute while achieving an increase in temperature of up to 100 degrees Fahrenheit over the ambient temperature of the amount of water (20).

The ambient temperature of the amount of water can be in the range of about 32 degrees Fahrenheit (about 0 degrees Celsius) at which the amount of water remains a liquid and about 110 degrees Fahrenheit (about 43 degrees Celsius). As to certain embodiments, the ambient temperature of the amount of water (20) can be selected from the group including or consisting of: about 32 degrees Fahrenheit and about 40 degrees Fahrenheit (about 0 degrees Celsius and about 4 degrees Celsius), about 35 degrees Fahrenheit and about 45 degrees Fahrenheit (about 2 degrees Celsius and about 7 degrees Celsius), about 40 degrees Fahrenheit and about 60 degrees Fahrenheit (about 4 degrees Celsius and about 15 degrees Celsius), about 50 degrees Fahrenheit and about 70 degrees Fahrenheit (about 10 degrees Celsius and about 21 degrees Celsius), about 60 degrees Fahrenheit and about 80 degrees Fahrenheit (about 16 degrees Celsius and about 27 degrees Celsius) about 70 degrees Fahrenheit and about 90 degrees Fahrenheit (about 21 degrees Celsius and about 32 degrees Celsius, about 80 degrees Fahrenheit and about 100 degrees Fahrenheit (about 27 degrees Celsius and about 38 degrees Celsius), and about 90 degrees Fahrenheit and about 110 degrees Fahrenheit (about 32 degrees Celsius and about 43 degrees Celsius).

Depending upon the ambient temperature of the amount of water (20) and the flow rate of the amount of water (20) through the transportable heating apparatus (35), the temperature of the amount of water delivered from the transportable heating apparatus (35) can be in the range of about 40 degrees Fahrenheit and about 150 degrees Fahrenheit. As to certain embodiments the temperature of the amount of water (20) delivered from the transportable heating apparatus (35) can be in a pre-selected temperature range selected from the group including or consisting of: about 40 degrees Fahrenheit and about 60 degrees Fahrenheit (about 4 degrees Celsius and about 15 degrees Celsius), about 50 degrees Fahrenheit and about 70 degrees Fahrenheit (about 10 degrees Celsius and about 21 degrees Celsius), about 60 degrees Fahrenheit and about 80 degrees Fahrenheit (about 16 degrees Celsius and about 27 degrees Celsius) about 70 degrees Fahrenheit and about 90 degrees Fahrenheit (about 21 degrees Celsius and about 32 degrees Celsius, about 80 degrees Fahrenheit and about 100 degrees Fahrenheit (about 27 degrees Celsius and about 38 degrees Celsius), about 90 degrees Fahrenheit and about 110 degrees Fahrenheit (about 32 degrees Celsius and about 43 degrees Celsius), about 100 degrees Fahrenheit and about 120 degrees Fahrenheit (about 38 degrees Celsius and about 49 degrees Celsius), about 110 degrees Fahrenheit and about 130 degrees Fahrenheit (about 43 degrees Celsius and about 54 degrees Celsius, about 120 degrees Fahrenheit and about 140 degrees Fahrenheit (about 49 degrees Celsius and about 60 degrees Celsius), and about 130 degrees Fahrenheit and about 150 degrees Fahrenheit (about 54 degrees Celsius and about 66 degrees Celsius).

To achieve an amount of water (20) continuously delivered from the transportable heating apparatus (35) at a flow rate of at least 400 gallons per minute in a pre-selected temperature range or having a pre-selected temperature, the ambient temperature of the amount of water (20) can be selected or the flow rate of the amount of water (20) at the ambient temperature delivered to the transportable heating apparatus can be selected, or both, prior to or during operation of the transportable heating apparatus (35). The transportable heating apparatus can further include a temperature sensor (48) which senses temperature of the amount of water (20) delivered from the transportable heating apparatus (35) to the second water flowline (47). The temperature sensor (48) can be coupled to a temperature controller (49) configured to regulate the flow of the amount of water (20) through the transportable heating apparatus (35) to the second water flowline (47) at the pre-selected temperature.

As an alternative, particular embodiments of the transportable water heater (35) can further include a water mixer (50) which proportionately mixes an amount of water (20) at the ambient temperature and an amount of water (20) heated by the heating apparatus (21) to deliver the amount of water (20) from the transportable heating apparatus (35) in a pre-selected temperature range or having a pre-selected temperature at a pre-selected flow rate.

Again referring primarily to FIGS. 3 and 4, as to those particular embodiments of the transportable water heater (35) which include a direct contact heater (27), the water tower (28) can take the form of a water tower assembly (51) comprising an upper water tower portion (52) and a lower water tower portion (53). The upper water tower portion (52) assembled to the lower water tower portion (53) can have a height of between about 15 feet and about 20 feet. The upper water tower portion (52) can disassemble from the lower water tower portion (53) but remain a part of the transportable water heater (35) for wheeled transport, as shown in the example of FIG. 4. The upper water tower portion (52) assembles to said lower tower portion (53) in situ for operation of the direct contact heater (27). Particular embodiments of the transportable heating apparatus (35) can further include a lift (54) configured to lift the upper water tower portion (52) in relation to the lower water tower portion (53) for in situ assembly and disassembly to the lower water tower portion (52).

Again referring primarily to FIGS. 3 and 4, the transportable heating apparatus (35) can further include a fuel delivery apparatus (55) configured to deliver an amount of fuel (56) to a combustion chamber (29) secured to the lower water tower portion (53) (as shown in the example of FIG. 4). As to particular embodiments of the transportable water heater (35), the fuel deliver apparatus (55) can include a fuel tank (56) and a fuel pump (57) regulated to deliver an amount of fuel (58) from the fuel tank (56) to the combustion chamber (29) of the direct contact heater (27). As to other embodiments, the fuel delivery apparatus (55) includes a fuel inlet fitting (59) configured to connect the transportable heating apparatus (35) to a fuel flowline (60) which delivers an amount of fuel (58) from a fuel source (61) discrete from the transportable heating apparatus (35) to a fuel pump (57) regulated to deliver said amount of fuel (58) to the combustion chamber (29). As to certain embodiments, the fuel source (61) can be a wellbore (24) which generates an amount of combustible gas (62) (or storage container in which combustible gas (62) from the wellbore (24) is stored). The combustible gas (62) delivered through the fuel flowline (60) to the heating apparatus (21). Understandably, the transportable heating apparatus (35) can be configured to operate using either an amount of fuel (32) contained within a fuel tank (56) as a part of the transportable heating apparatus (35) or contained within a fuel source (61) discrete from the transportable heating apparatus (35).

Now referring primarily to FIG. 3, the transportable heating apparatus (35) can further include a water supply pump (63) fluidly coupled to the first water flowline (45). The water supply pump (63) configured to deliver the amount of water (20) at the ambient temperature to the upper water tower portion (52) of the water tower assembly (51) and can further include a water output pump (64) fluidly coupled to the second water flowline (47). The water outlet pump (64) configured to deliver the amount of water (20) from said lower water tower portion (53) of the water tower assembly (51) to the one or more fracturing pumps (22) at the flow rates and temperatures above described.

Again referring to FIGS. 3 and 4, the transportable heating apparatus (35) can further include a generator (34) which supplies electrical power for operation of the water supply pump (63), the water output pump (64), the air flow generator (30), the computer implemented controller (49), the temperature sensor, the water mixer (50), fuel pump (57), and other electrical components of the transportable heating apparatus (35).

As can be easily understood from the foregoing, the basic concepts of the present invention may be embodied in a variety of ways. The invention involves numerous and varied embodiments of a hydraulic fracturing system including embodiments of a heating apparatus useful in systems for the hydraulic fracturing of geologic formations and methods for making and using such embodiments of the hydraulic fracturing system and heating apparatus including the best modes.

As such, the particular embodiments or elements of the invention disclosed by the description or shown in the figures or tables accompanying this application are intended to be exemplary of the numerous and varied embodiments generically encompassed by the invention or equivalents encompassed with respect to any particular embodiment, element, limitation or step thereof. In addition, the specific description of a single embodiment, element, limitation or step of the invention may not explicitly describe all embodiments, elements, limitations or steps possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "heater" should be understood to encompass disclosure of the act of "heating" —whether explicitly discussed or not—and, conversely, were there effectively disclosure of the act of "heating", such a disclosure should be understood to encompass disclosure of a "heater" and even a "means for heating". Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the hydraulic fracturing systems and heating apparatus herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A method of hydraulic fracturing of a geologic formation, comprising:

a) flowing an amount of water from a water source to a direct contact heater, said amount of water having an ambient temperature of between about 32 degrees Fahrenheit and about 110 degrees Fahrenheit (about 0 degrees Celsius and about 43 degrees Celsius);

b) continuously flowing said amount of water through said direct contact heater at a flow rate of between about 500 gallons per minute and about 2100 gallons per minute;

c) heating said amount of water with said direct contact heater from said ambient temperature to a temperature of between about 40 degrees Fahrenheit and about 150 degrees Fahrenheit (about 4 degrees Celsius and about 66 degrees Celsius);

d) delivering said amount of water from said direct contact heater to one or more fracturing pumps; and e) injecting said amount of water into a wellbore at sufficient pressure for hydraulic fracturing of said geologic formation.

2. The method of hydraulic fracturing of a geologic formation of claim 1, wherein said ambient temperature of said amount of water delivered from said water source to said heating apparatus is selected from the group consisting of: about 35 degrees Fahrenheit and about 40 degrees Fahrenheit (about 1.5 degrees Celsius and about 4 degrees Celsius), about 31 degrees Fahrenheit and about 45 degrees Fahrenheit (about 0.5 degrees Celsius and about 7 degrees Celsius), about 40 degrees Fahrenheit and about 60 degrees Fahrenheit (about 4 degrees Celsius and about 15 degrees Celsius), about 50 degrees Fahrenheit and about 70 degrees Fahrenheit (about 10 degrees Celsius and about 21 degrees Celsius), about 60 degrees Fahrenheit and about 80 degrees Fahrenheit (about 16 degrees Celsius and about 27 degrees Celsius) about 70 degrees Fahrenheit and about 90 degrees Fahrenheit (about 21 degrees Celsius and about 32 degrees Celsius, about 80 degrees Fahrenheit and about 100 degrees Fahrenheit (about 27 degrees Celsius and about 38 degrees Celsius), and about 90 degrees Fahrenheit and about 105 degrees Fahrenheit (about 32 degrees Celsius and about 41 degrees Celsius).

3. The method of hydraulic fracturing of a geologic formation of claim 2, wherein said amount of water delivered from said heating apparatus has a temperature selected from the group consisting of: about 7 degrees Fahrenheit and about 60 degrees Fahrenheit (about 4 degrees Celsius and about 15 degrees Celsius), about 50 degrees Fahrenheit and about 70 degrees Fahrenheit (about 10 degrees Celsius and about 21 degrees Celsius), about 60 degrees Fahrenheit and about 80 degrees Fahrenheit (about 16 degrees Celsius and about 27 degrees Celsius) about 70 degrees Fahrenheit and about 90 degrees Fahrenheit (about 21 degrees Celsius and about 32 degrees Celsius, about 80 degrees Fahrenheit and about 100 degrees Fahrenheit (about 27 degrees Celsius and about 38 degrees Celsius), about 90 degrees Fahrenheit and about 110 degrees Fahrenheit (about 32 degrees Celsius and about 43 degrees Celsius), about 100 degrees Fahrenheit and about 120 degrees Fahrenheit (about 38 degrees Celsius and about 49 degrees Celsius), about 110 degrees Fahrenheit and about 130 degrees Fahrenheit (about 43 degrees Celsius and about 54 degrees Celsius, about 120 degrees Fahrenheit and about 140 degrees Fahrenheit (about 49 degrees Celsius and about 60 degrees Celsius), and about 130 degrees Fahrenheit and about 150 degrees Fahrenheit (about 54 degrees Celsius and about 63 degrees Celsius).

4. The method of hydraulic fracturing of a geologic formation of claim 3, wherein said flow rate of said amount of water is selected from the group consisting of: between about 550 gallons per minute and about 700 gallons per minute, between about 600 gallons per minute and about 800 gallons per minute, between about 700 gallons per minute and about 900 gallons per minute, between about 800 gallons per minute and about 1,000 gallons per minute, between about 900 gallons per minute and about 1100 gallons per minute, between about 1,000 gallons per minute and about 1,200 gallons per minute, between about 1,100 gallons per minute and about 1,300 gallons per minute, between about 1,200 gallons per minute and about 1,400 gallons per minute, between about 1,300 gallons per minute and about 1,500 gallons per minute, between about 1,400 gallons per minute and about 1,600 gallons per minute, between about 1,500 gallons per minute and about 1,700 gallons per minute, between about 1,600 gallons per minute and about 1,800 gallons per minute, between about 1,700 gallons per minute and about 1,900 gallons per minute, between about 1,800 gallons per minute and about 2,000 gallons per minute, and between about 1,900 gallons per minute and about 2,000 gallons per minute.

5. The method of hydraulic fracturing of a geologic formation of claim 1, wherein said direct contact heater comprises a water tower having an upper water tower portion and a lower water tower portion.

6. The method of hydraulic fracturing of a geologic formation of claim 5, further comprising transporting said upper water tower portion and said lower water tower portion in a disassembled condition.

7. The method of hydraulic fracturing of a geologic formation of claim 6, further comprising assembling said upper water tower portion and said lower water tower portion in situ for operation of said direct contact heater.

8. The method of hydraulic fracturing of a geologic formation of claim 7, further comprising lifting said upper tower portion into position for assembly with said lower tower portion in situ.

9. The method of hydraulic fracturing of a geologic formation of claim 8, further comprising delivering an amount of fuel to a combustion chamber secured to said lower portion of said water tower.

10. The method of hydraulic fracturing of a geologic formation of claim 9, wherein delivering an amount of fuel to said combustion chamber secured to said lower portion of said water tower comprises delivering an amount of gas from a wellbore.

11. The method of hydraulic fracturing of a geologic formation of claim 1, further comprising sensing a temperature of said amount of water prior to delivering said amount of water from said heating apparatus to said one or more fracturing pumps.

12. The method of hydraulic fracturing of a geologic formation of claim 11, further comprising pre-selecting said temperature of said amount of water prior to delivering said amount of water from said heating apparatus to said one or more fracturing pumps.

13. The method of hydraulic fracturing of a geologic formation of claim 12, further comprising controlling said temperature of said amount of water to achieve a pre-selected temperature prior to delivering said amount of water from said heating apparatus to said one or more fracturing pumps by mixing said amount of water at said ambient temperature and said amount of water from said lower tower portion of said water tower.

14. The method of hydraulic fracturing of a geologic formation of claim 1, wherein said heating apparatus comprises a transportable heating apparatus including a wheeled vehicle.

15. The method of hydraulic fracturing of a geologic formation of claim 1, wherein only one said direct contact heater heats said amount of water from said ambient temperature to a temperature of between about 40 degrees Fahrenheit and about 150 degrees Fahrenheit (about 4 degrees Celsius and about 66 degrees Celsius).

16. The method of hydraulic fracturing of a geologic formation of claim 1, wherein only said amount of water from said direct contact heater is delivered to said one or more fracturing pumps.

17. The method of hydraulic fracturing of a geologic formation of claim 1, wherein said amount of water passes only once through said direct contact heater at a flow rate of between about 500 gallons per minute and about 2100 gallons per minute.

18. The method of hydraulic fracturing of a geologic formation of claim 1, further comprising mixing an amount of hydratable composition into said amount of water prior to delivering said amount of water to said one or more fracturing pumps.

19. The method of hydraulic fracturing of a geologic formation of claim 1, further comprising mixing an amount of proppant into said amount of water prior to delivering said amount of water to said one or more fracturing pumps.

* * * * *